United States Patent [19]

Tabet

[11] 3,938,127

[45] Feb. 10, 1976

[54] ALARM DEVICE

[75] Inventor: Michael A. Tabet, Norfolk, Va.

[73] Assignee: Hughes D. Burton, Norfolk, Va. ; a part interest

[22] Filed: July 22, 1974

[21] Appl. No.: 490,743

[52] U.S. Cl. ..... 340/304; 116/114 F; 73/421.5 R

[51] Int. Cl.[2] ..... G08B 25/00

[58] Field of Search..... 340/304, 289, 237 R, 240; 116/114 F; 73/421.5 R, 23

[56] References Cited

UNITED STATES PATENTS 3,144,850 8/1964 Rosenberg ..... 340/237 R 3,817,108 6/1974 Principe ..... 73/421.5 R

*Primary Examiner*—John W. Caldwell
*Assistant Examiner*—William M. Wannisky
*Attorney, Agent, or Firm*—Clelle W. Upchurch

[57] ABSTRACT

A device adapted to be associated with a fire alarm box or the like to assist in the identification of a person who actuates the mechanism of an alarm box has an evacuated container disposed to entrap air from around the person when the vacuum is broken and a means responsive to the actuation of the mechanism for opening the container to the atmosphere.

6 Claims, 4 Drawing Figures

ALARM DEVICE

This invention relates generally to alarm systems and more particularly to a device adapted to assist in the identification of one who initiates the mechanism of a fire alarm box.

Many municipalities have a fire alarm system which includes fire alarm boxes located at various sites about the municipality and connected to a control center such as a fire station. These alarm boxes are provided with a lever which actuates a mechanism enclosed in the box adapted to transmit a coded electrical signal which identifies the location of the box.

Unfortunately, the fire alarm box is accessible to the prankster and persons who enjoy watching the fire fighters in action whether there is a fire or not. Such persons sometimes turn in a false alarm for the pleasure of observing the commotion resulting therefrom.

Various types of devices have been proposed for use with fire alarm boxes to discourage one from initiating a false alarm or to assist in apprehending one who does. For example, a device adapted to enclose the person who signals an alarm with a screen is disclosed in U.S. Pat. No. 320,068, while a device adapted to hold by the wrist anyone who signals an alarm is disclosed in U.S. Pat. No. 640,872. Such devices are impractical, however, because they capture the person who is acting in good faith as well as one who purposely signals a flase alarm. A device which emits an audible alarm to alert those within the vicinity of a fire alarm box that an alarm is being turned in is disclosed in U.S. Pat. No. 3,116,479. This device is suppose to discourage false alarms but it has the disadvantage of discouraging the timid from turning in an alarm as well. Moreover, it alerts the person who is acting in bad faith to leave the vicinity of the fire alarm box to avoid identification by those who saw him near the box when the alarm sounded.

It is therefore an object of this invention to provide an improved means for assisting in the identification and capture of one who falsely initiates an alarm. Another object of the invention is to provide a fire alarm box with an apparatus which will assist in apprehending anyone who falsely signals an alarm from the alarm box but does not inconvenience one who is acting in good faith.

Other objects will become apparent from the following description with reference to the accompanying drawing wherein.

The foregoing objects and others are accomplished in accordance with this invention, generally speaking, by providing for a fire alarm box having a conventional actuating mechanism for signaling an alarm to a control point of an alarm system, an evacuated container disposed near the box and means for opening the evacuated container when the mechanism is actuated to transmit an alarm signal. Any suitable alarm actuating mechanism such as, for example the one described and illustrated in U.S. Pat. No. 1,479,608 granted Jan. 1, 1924 may be combined with the novel apparatus provided by the invention. The evacuated container may be conveniently a glass bottle, tube or jar disposed with respect to the signal transmitting apparatus in the box where it will be broken or punctured when the lever is pulled. The container is arranged with respect to the mechanism's actuating lever so that air around the front of the alarm box will be drawn into the container when the vacuum is broken to equalize the pressure therein with the surrounding atmospheric pressure. This air will include the odor of the person's body who actuated the lever. This air will remain in the bottle until it is desired to withdraw it and can be used by a canine corps of a police department to track down the person who turned in the alarm. Experience has indicated that false alarms are usually initiated by someone residing in the vicinity of the box and that those who are prone to initiate false alarms wait to witness the results of their misconduct. Hence, such a person can be expected to remain in the vicinity of the box where he can be easily located with a trained dog.

Figure 1:
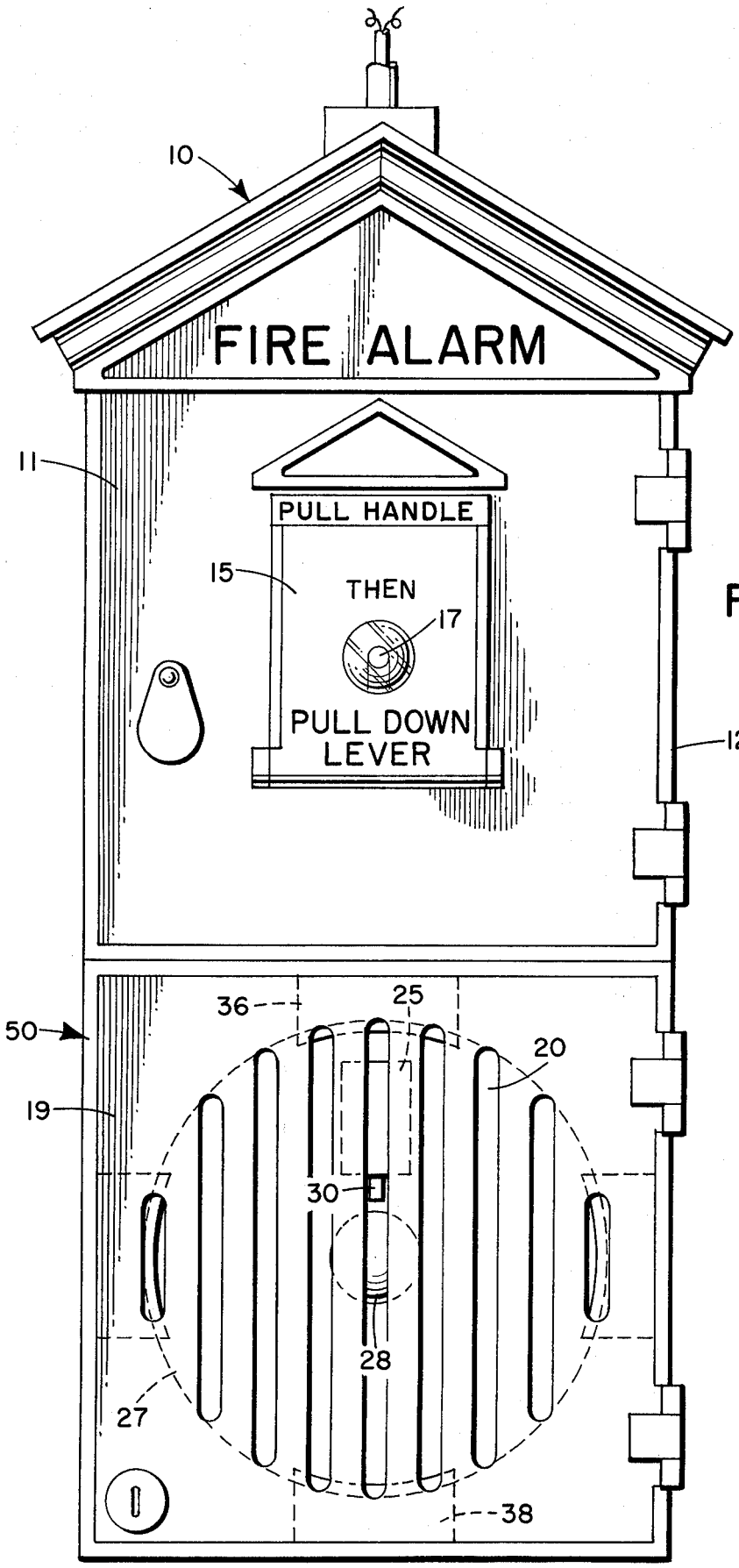
FIG. 1 is a front elevation of one embodiment of the invention combined with a conventional fire alarm box.
Figure 2:
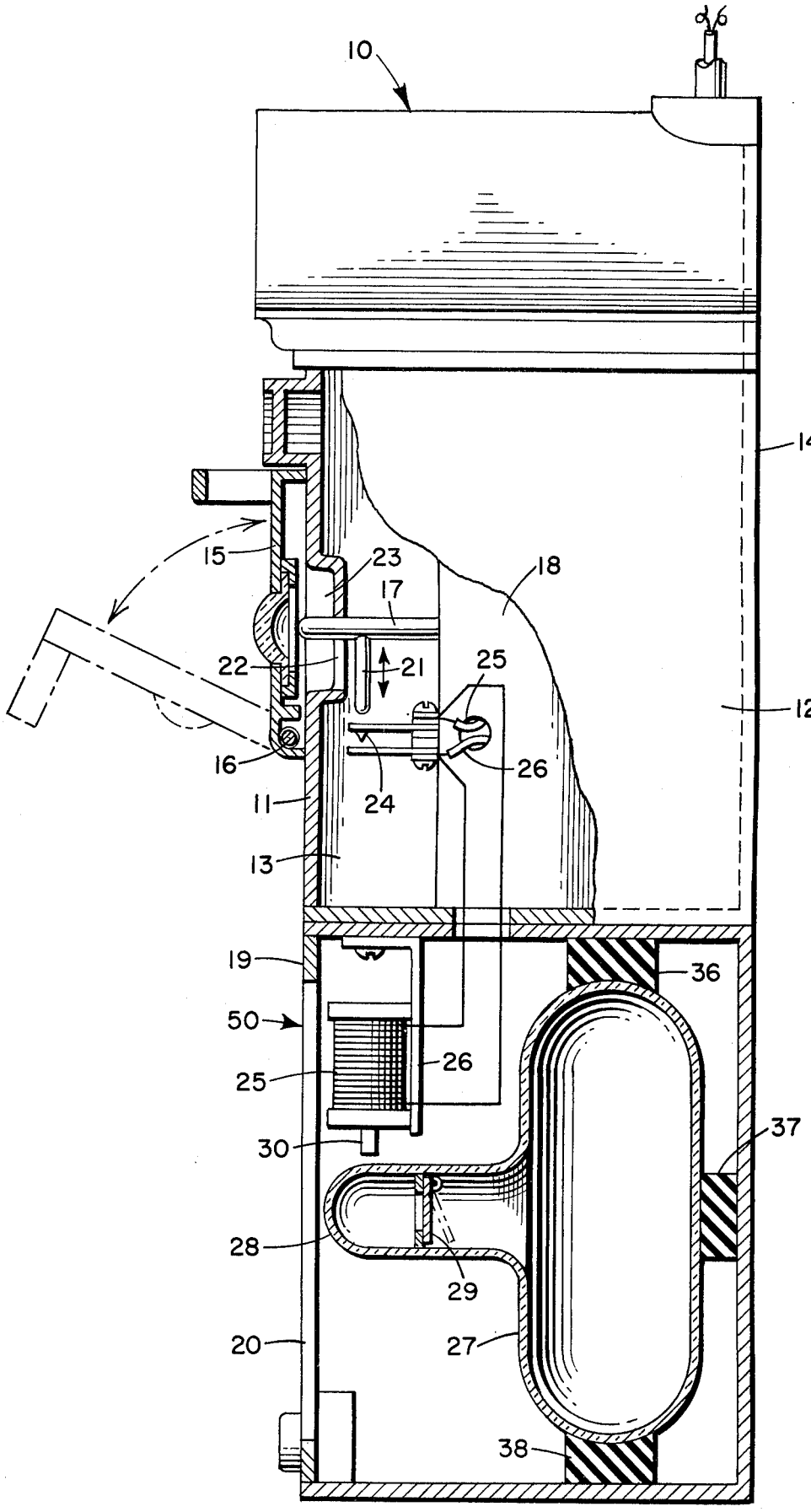
FIG. 2 is a side elevation, partially broken away, of the embodiment of FIG. 1.

Referring now to the drawing, one embodiment of the invention is illustrated in FIGS. 1 and 2. A fire alarm box has a conventional housing 10 with a hinged front door 11, sidewalls 12 and 13 and a backwall 14. A small door 15 pivotally mounted at the bottom on a pin 16 is provided on the front of the door 11 over an opening through door 11 which permits access to a lever 17. A spring (not shown) coiled about pin 16 biases the door 15 into its closed position. The handle on door 15 is pulled downwardly to overcome the biasing force of the spring and to expose the lever arm 17 when an alarm is to be initiated. Lever 17 actuates a conventional clock-like mechanism of the type disclosed in U.S. Pat. No. 1,479,608 enclosed within a box 18 which sends a coded electrical signal to a fire station or the like. The apparatus so far described with reference to FIGS. 1 and 2 is all conventional. In accordance with this invention, however, a second box 50 is provided immediately below the conventional fire alarm box. It may be supported on the post or wall which supports the alarm box. A door 19 which forms the front wall of the housing of box 50 is provided with a grid or screen 20 which permits air to flow into the box 50.

A rod 21 is welded or otherwise secured at one end to lever 17 so that it depends therefrom. A coil spring (not shown) on the back of door 11 biases lever 17 to the top surface of a slot 22 in a pocket 23 in door 11.

A switch 24 connected to insulated wires 25 and 26 is disposed below the free end of rod 21 where it will be struck by the rod 21 and closed when lever 17 is pulled down to actuate the alarm mechanism. Switch 24 is electrically connected to a solenoid 25 supported on a bracket 26 in box 50. An evacuated glass bottle 27 is supported by members 36, 37 and 38 in box 50 with its fragile neck 28 positioned below plunger 30 of solenoid 25. A flap valve 29 may be disposed in neck 28 to permit flow of air into glass bottle 27 but prevent escape of air from the bottle 27.

When lever 17 is moved downwardly in slot 22 to actuate the alarm signaling mechanism, rod 21 closes switch 24 and solenoid 25 is actuated to cause plunger 30 to strike fragile neck 28 and break it. Air is drawn through the openings in grid 20 into bottle 27 until the pressure inside the bottle equals atmospheric pressure. If the alarm was falsely initiated, the contents of bottle 27 can be exposed to the nose of a trained dog for use in tracking down the person in front of the grid when the bottle was opened.

A valve 29 is illustrated in the drawing but it is not an essential part of the device. Since the pressure in bottle 27 will become equal to that around the bottle when neck 28 is fractured, the air sucked into the bottle will remain therein for an appreciable period of time without a valve in neck 28. A valve is preferred, however, to insure against dilution of the air in bottle 27.

Figure 4:
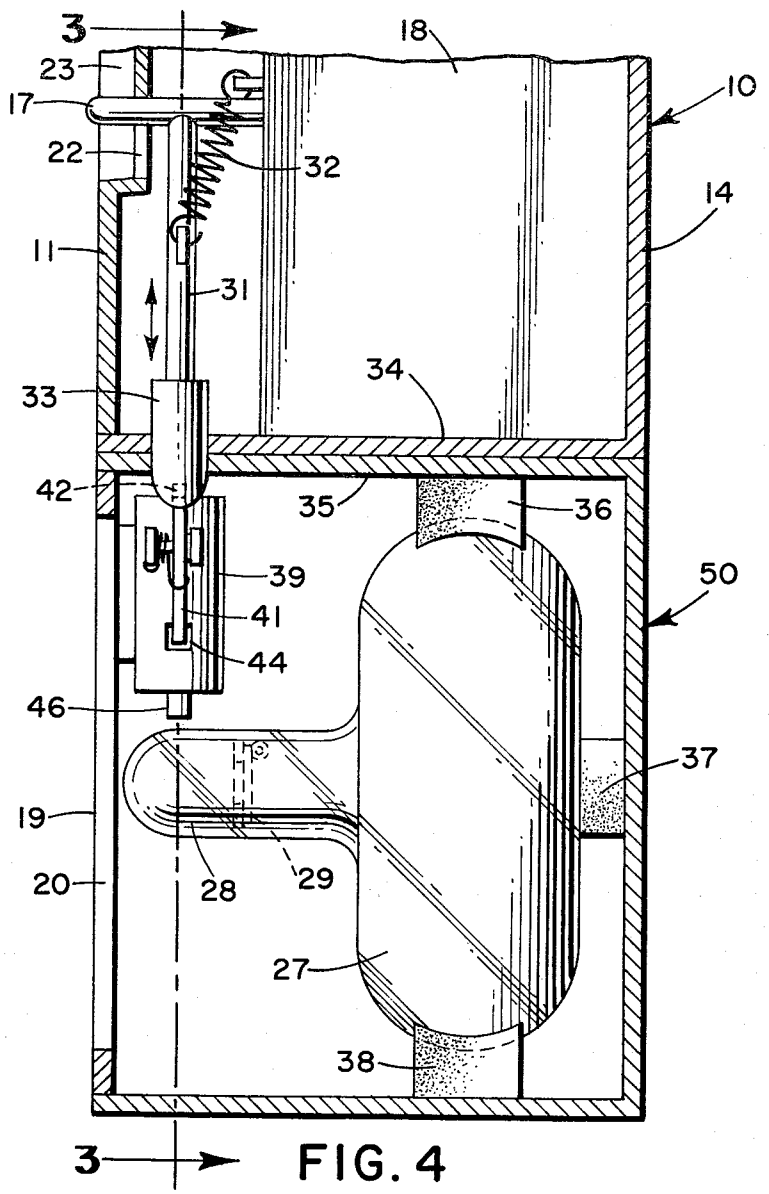
FIG. 4 is a fragmentary longitudinal section taken along the line 4—4 of FIG. 3.
Figure 3:
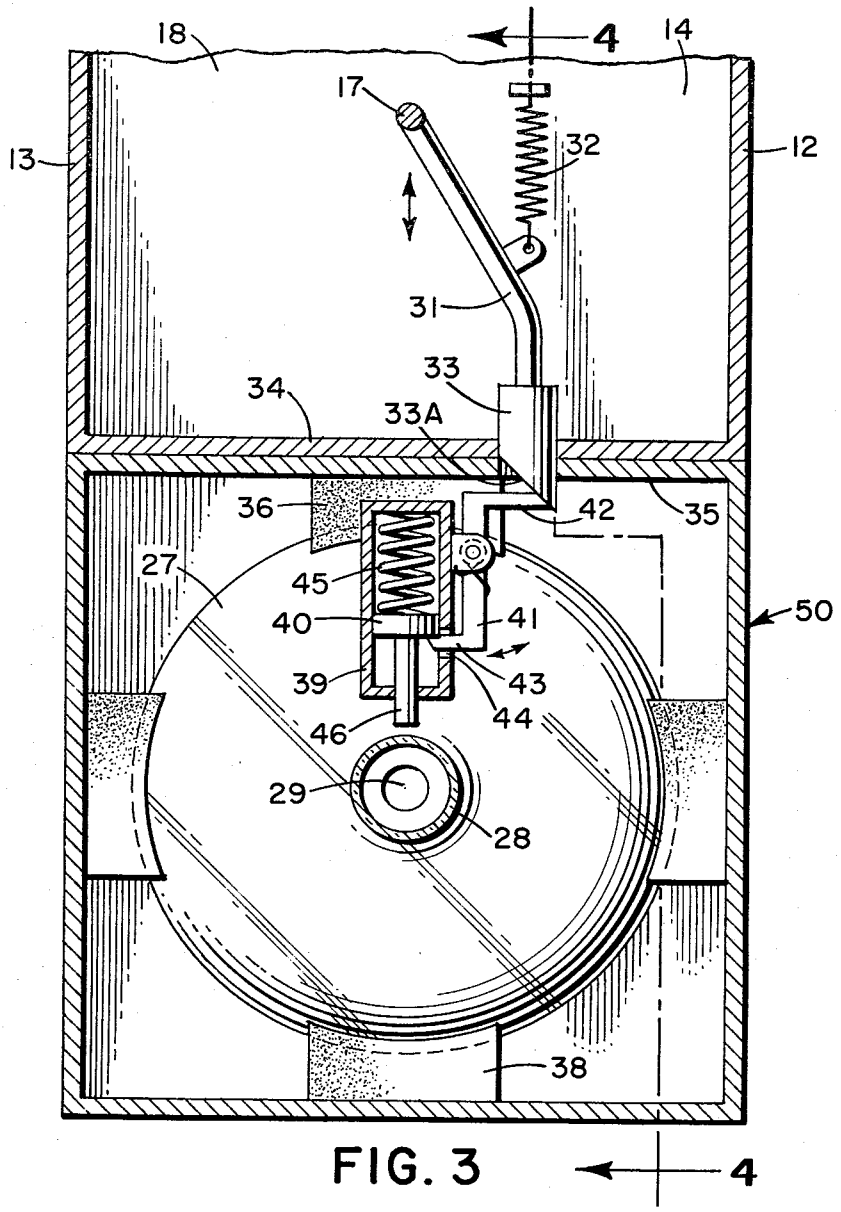
FIG. 3 is a fragmentary longitudinal section taken along the line 3—3 of FIG. 4 of a second embodiment of the invention.

In the embodiment illustrated in FIGS. 3 and 4, a rod 31 is secured at one end of lever 17. A spring 32 biases lever 17 into the position in slot 22 illustrated in FIG. 4. A cylindrical member 33 is secured to the lower end of rod 31 and extends into box 50 through openings in the bottom wall 34 of the alarm box and the top 35 of box 50. The unsecured end of member 33 has a sloping surface 34. A bottle 27 is supported in box 50 by members 36, 37 and 38. A cylindrical housing 39 forms a cylinder in which a piston 40 is slidably disposed. A trigger 41 is pivotally mounted on housing 39. One end 42 of trigger 41 is bent at a right angle and has a sloping end surface slidably disposed against surface 34 of member 33. The opposite end 43 of trigger 41 is bent at a right angle and extends through a slot 44 in housing 39 when the trigger 41 is in its set position illustrated in FIGS. 3 and 4. End member 43 of trigger 41 supports piston 40 with a spring 45 compressed between piston 40 and the top of housing 39. The plunger 46 of piston 40 is poised above neck 28 when the apparatus is in its illustrated ready position.

When lever 17 is pulled down to initiate the alarm mechanism, rod 31 and member 33 move downwardly to pivot trigger 41 to a position where end member 43 is withdrawn from below piston 40. Plunger 46 is driven by spring 45 against fragile neck 28 with sufficient force to fracture it. Air carrying the odor of the person's body who pulled lever 17 is sucked through the openings in grid 20 into bottle 27. Valve 29 seals neck 28 against loss of air from bottle 27.

It will be apparent from the foregoing description that the device provided by the invention accomplishes the objectives. The contents of the bottle may be used to trace the person who actuated the alarm mechanism only if the alarm were false. Hence, innocent persons who act in good faith are not inconvenienced by embarassment or incarceration.

Although the invention has been described in detail for the purpose of illustration, it is to be understood that such detail is solely for that purpose and that variations can be made therein by those skilled in the art without departing from the spirit and scope of the invention except as it may be limited by the claims.

I claim:

1. An apparatus for initiating an alarm and assisting in the identification of the person initiating the alarm comprising an alarm signalling means, movable means for initiating the signalling means, an evacuated container adapted to be opened to the atmosphere, and means responsive to movement of the movable means for opening the container, said container being disposed where air about the said movable means is drawn into the container when the container is opened, said air carrying the characteristic scent of the person initiating the alarm.

2. The apparatus of claim 1 wherein said movable means a lever to be moved to initiate an alarm, an electrical switch, means connected to said lever for closing the electrical switch when the lever is moved to initiate an alarm, a solenoid electrically connected to the switch having a plunger which is moved outwardly when the solenoid is electrically energized, and an evacuated container disposed with a wall adapted to be broken by the plunger where it will be struck by the plunger when the solenoid is energized, said container being located with respect to the lever whereby air about the body of anyone actuating the lever will be sucked into the container when the vacuum is broken.

3. The apparatus of claim 1 wherein said apparatus has a lever to be moved to actuate the alarm signalling means, a rod secured to the lever to be moved therewith, and a piston having a plunger adapted to strike the container when the piston is actuated, and means responsive to movement of the lever to actuate the piston.

4. The apparatus of claim 1 wherein said apparatus has a lever to be moved to actuate the alarm signalling means and means associated with the lever for opening the container comprising a housing enclosing a cylinder, a piston having a plunger slidably disposed in the cylinder, said cylinder being associated with the container whereby the plunger will open the container when the piston is actuated, resilient means for actuating the piston, and trigger means for releasing the piston in response to actuation of the lever.

5. The apparatus of claim 1 wherein the container has a valve which permits flow of fluid into the container when it is open but prevents flow of fluid from the container. and air 6. The apparatus of claim 1 comprising a fire alarm box and an electrical circuit connected to a signalling means at a fire station, a lever movable from points where the circuit is broken and where is is electrically connected to the signalling means, said lever being disposed where it can be actuated by a person, and an evacuated container adapted to be opened by movement of the lever and associated with the said box where it is opened upon movement of the lever andair about a person actuating the lever is drawn into the container.

* * * * *